US006067675A

United States Patent [19]

Boyette

[11] Patent Number: 6,067,675

[45] Date of Patent: May 30, 2000

[54] FOOT OPERATED FAUCET SYSTEM

[76] Inventor: John Boyette, 13204 Marrero Dr., Austin, Tex. 78729

[21] Appl. No.: 09/388,957

[22] Filed: Sep. 2, 1999

[51] Int. Cl.[7] ..... E03C 1/04

[52] U.S. Cl. ..... 4/677; 4/676; 251/295; 137/625.41

[58] Field of Search ..... 4/675–678; 251/295, 251/296; 137/625.41

[56] References Cited

U.S. PATENT DOCUMENTS 3,701,364 10/1972 Hare ..... 137/625.41
5,263,684 11/1993 McGuire ..... 251/295
5,386,600 2/1995 Gilbert, Sr. ..... 4/677
5,813,435 9/1998 Knapp ..... 137/625.41

*Primary Examiner*—Henry J. Recla
*Assistant Examiner*—Tuan Nguyen

[57] ABSTRACT

A new foot operated faucet system for permitting operation of the faucet by a user using their feet. The inventive device includes a foot pedal movably coupled to a base, a swivel bar coupled between the foot pedal and a mixing valve for permitting adjustment of the passing of a mixture of hot and cold water through the mixing valve.

12 Claims, 3 Drawing Sheets

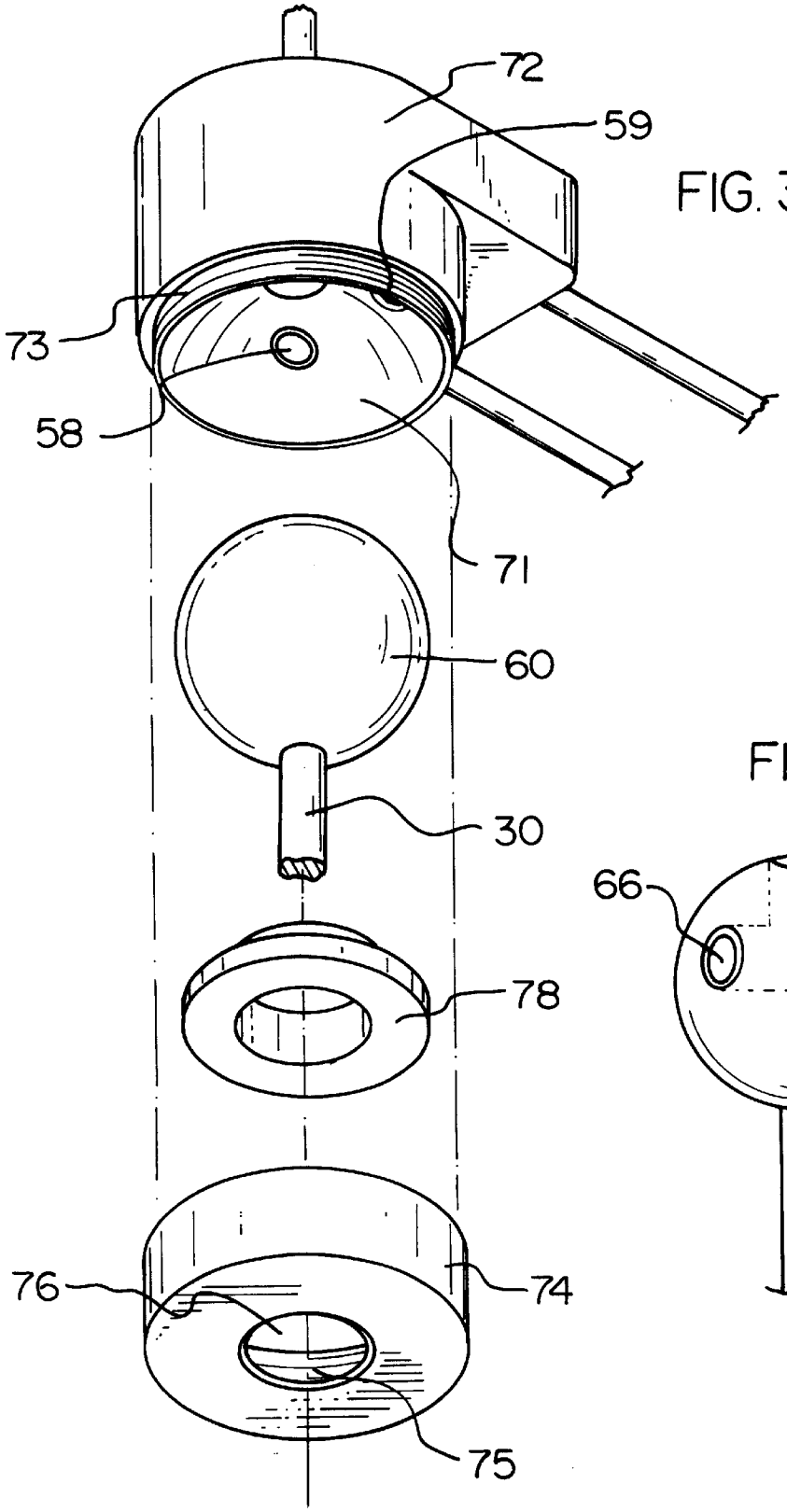
FIG. 3
FIG. 4
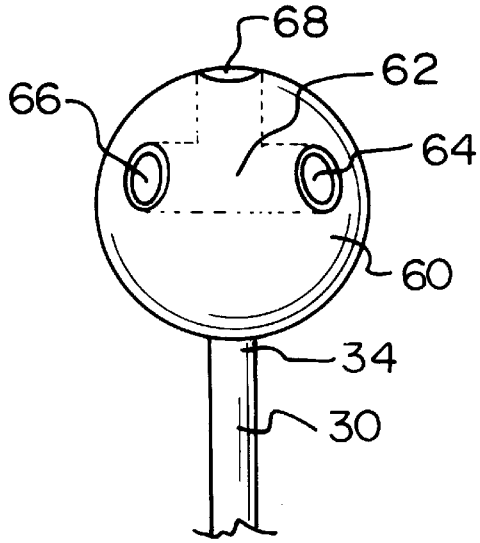

FOOT OPERATED FAUCET SYSTEM

BACKGROUND OF THE INVENTION

1. Field of the Invention

The present invention relates to faucets and more particularly pertains to a new foot operated faucet system for permitting operation of the faucet by a user using their feet.

2. Description of the Prior Art

The use of faucets is known in the prior art. More specifically, faucets heretofore devised and utilized are known to consist basically of familiar, expected and obvious structural configurations, notwithstanding the myriad of designs encompassed by the crowded prior art which have been developed for the fulfillment of countless objectives and requirements.

Known prior art faucets include U.S. Pat. No. 5,386,600; U.S. Pat. No. 5,226,629; U.S. Pat. No. 5,263,684; U.S. Pat. No. Des. 277,838; U.S. Pat. No. 5,082,026; and U.S. Pat. No. 5,363,880.

While these devices fulfill their respective, particular objectives and requirements, the aforementioned patents do not disclose a new foot operated faucet system. The inventive device includes a foot pedal movably coupled to a base, a swivel bar coupled between the foot pedal and a mixing valve for permitting adjustment of the passing of a mixture of hot and cold water through the mixing valve.

In these respects, the foot operated faucet system according to the present invention substantially departs from the conventional concepts and designs of the prior art, and in so doing provides an apparatus primarily developed for the purpose of permitting operation of the faucet by a user using their feet.

SUMMARY OF THE INVENTION

In view of the foregoing disadvantages inherent in the known types of faucets now present in the prior art, the present invention provides a new foot operated faucet system construction wherein the same can be utilized for permitting operation of the faucet by a user using their feet.

The general purpose of the present invention, which will be described subsequently in greater detail, is to provide a new foot operated faucet system apparatus and method which has many of the advantages of the faucets mentioned heretofore and many novel features that result in a new foot operated faucet system which is not anticipated, rendered obvious, suggested, or even implied by any of the prior art faucets, either alone or in any combination thereof.

To attain this, the present invention generally comprises a foot pedal movably coupled to a base, a swivel bar coupled between the foot pedal and a mixing valve for permitting adjustment of the passing of a mixture of hot and cold water through the mixing valve.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new foot operated faucet system apparatus and method which has many of the advantages of the faucets mentioned heretofore and many novel features that result in a new foot operated faucet system which is not anticipated, rendered obvious, suggested, or even implied by any of the prior art faucets, either alone or in any combination thereof.

It is another object of the present invention to provide a new foot operated faucet system that may be easily and efficiently manufactured and marketed.

It is a further object of the present invention to provide a new foot operated faucet system that is of a durable and reliable construction.

An even further object of the present invention is to provide a new foot operated faucet system which is susceptible of a low cost of manufacture with regard to both materials and labor, and which accordingly is then susceptible of low prices of sale to the consuming public, thereby making such foot operated faucet system economically available to the buying public.

Still yet another object of the present invention is to provide a new foot operated faucet system which provides in the apparatuses and methods of the prior art some of the advantages thereof, while simultaneously overcoming some of the disadvantages normally associated therewith.

Still another object of the present invention is to provide a new foot operated faucet system for permitting operation of the faucet by a user using their feet.

Yet another object of the present invention is to provide a new foot operated faucet system which includes a foot pedal movably coupled to a base, a swivel bar coupled between the foot pedal and a mixing valve for permitting adjustment of the passing of a mixture of hot and cold water through the mixing valve.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an exploded view of the mixing valve of the present invention.

FIG. 4 is a perspective view of the mixing ball of the present invention.

DESCRIPTION OF THE PREFERRED EMBODIMENT

Figure 2:
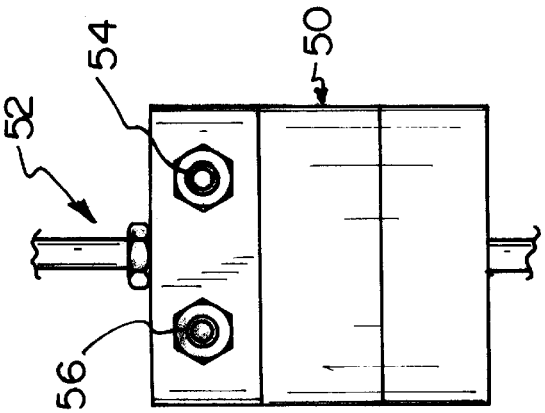
FIG. 2 is a rear view of the mixing valve of the present invention.
Figure 1:
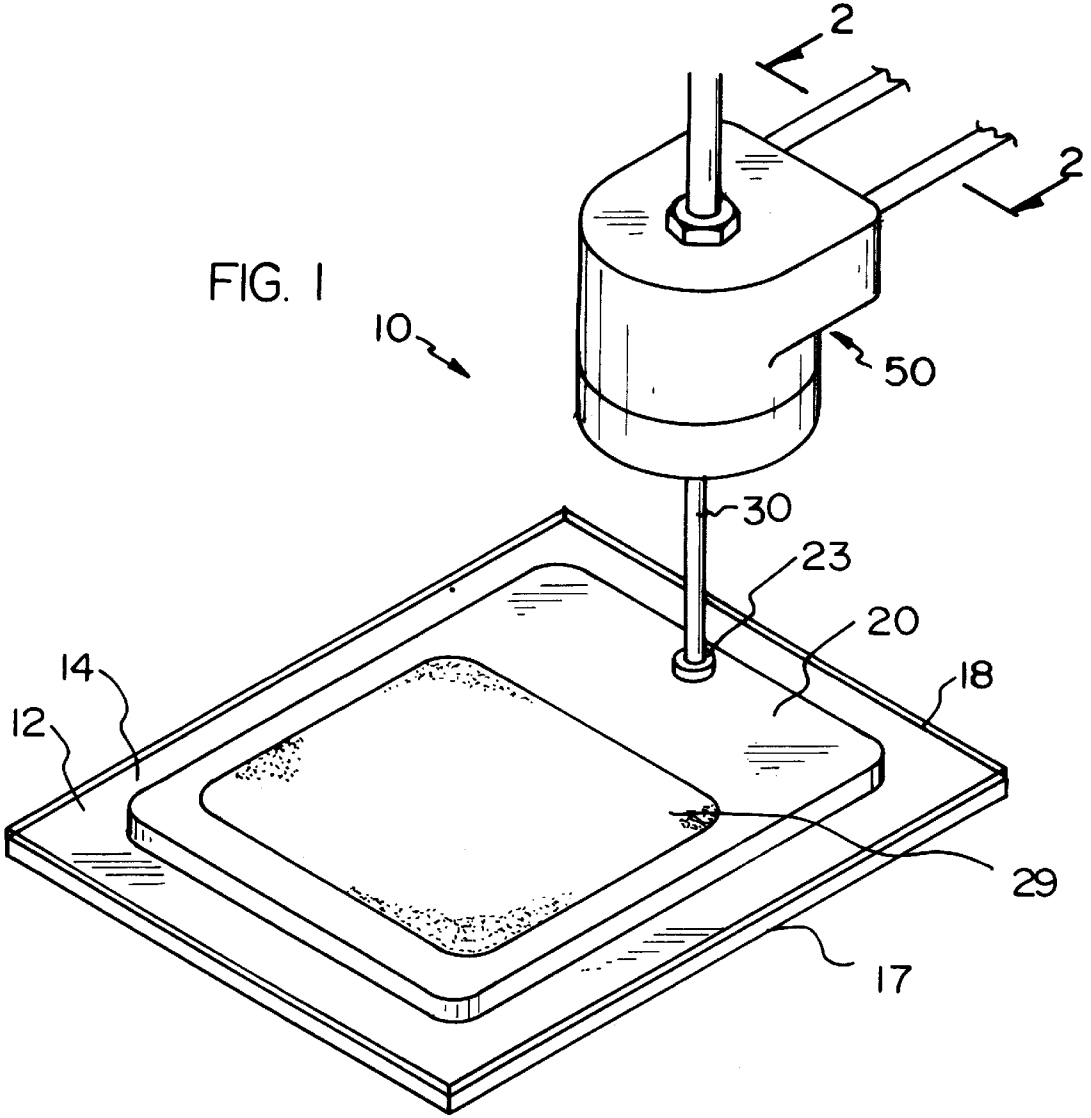
FIG. 1 is a perspective view of a new foot operated faucet system according to the present invention.
Figure 5:
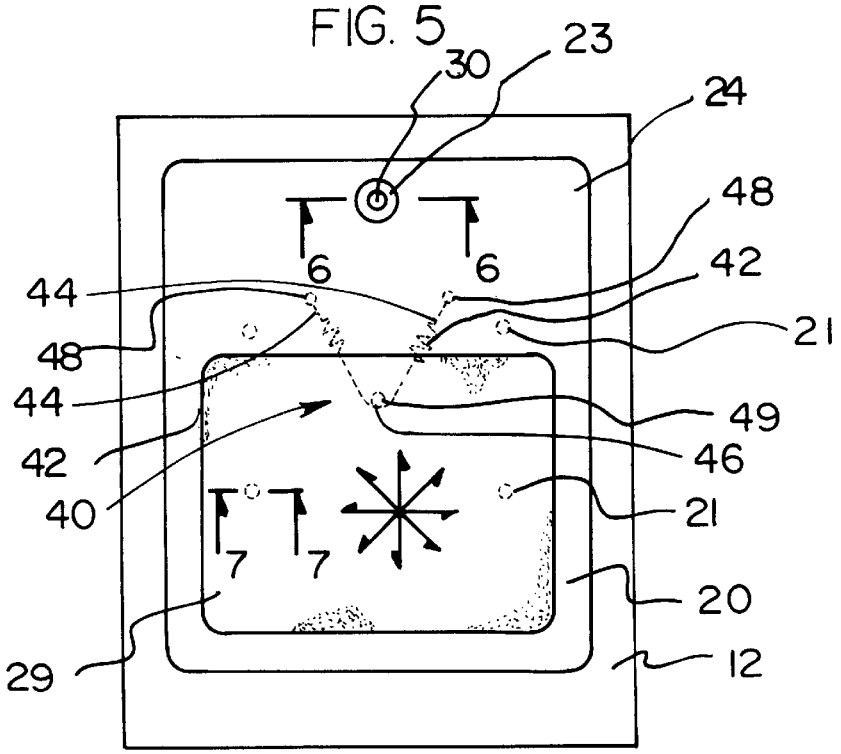
FIG. 5 is a top view of the base and foot pedal of the present invention.
Figure 6:
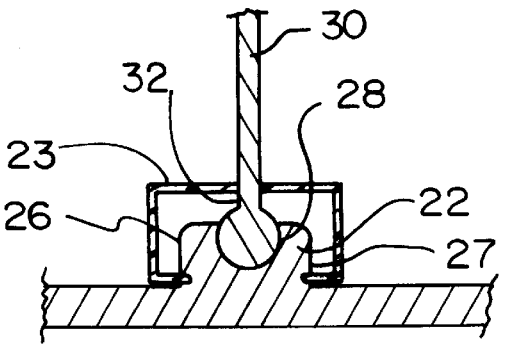
FIG. 6 is a cross-sectional view of the present invention taken along line 6—6 of FIG. 5.
Figure 7:
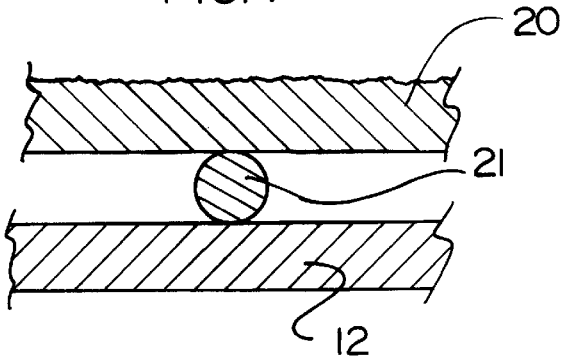
FIG. 7 is a cross-sectional view of the present invention taken along line 7—7 of FIG. 5.

With reference now to the drawings, and in particular to FIGS. 1 through 7 thereof, a new foot operated faucet system embodying the principles and concepts of the present invention and generally designated by the reference numeral 10 will be described.

As best illustrated in FIGS. 1 through 7, the foot operated faucet system 10 comprises a base member 12, a foot pedal 20, a swivel bar 30, and a mixing valve 50.

The foot pedal is operationally coupled to the base member such that the foot pedal is movable within a plane substantially parallel to an upper surface 14 of the base member. In an embodiment, the foot pedal includes a gripping surface portion 29 for facilitating movement of the foot pedal by a foot.

The swivel bar includes a first end 32 and a second end 34. The foot pedal includes a swivel bar receiver 22 extending upwardly from an upper surface 24 of the foot pedal. The swivel bar receiver includes a swivel receiver 28 for receiving the first end 32 of the swivel bar such that the swivel bar is operationally coupled to the foot pedal. A grommet 23, preferably made of rubber, is coupled to the swivel bar receiver around the swivel bar. The swivel bar receiver includes a groove 27 extending around an outer peripheral wall 26 of the swivel bar receiver. The groove is designed for receiving a portion of the grommet therein, whereby the grommet is coupled to the swivel bar receiver.

In an embodiment, a plurality of ball bearings 21 are positioned between the foot pedal and the base for facilitating movement of the foot pedal relative to the base.

The mixing valve includes a mixing ball 60, an outlet port 52, a hot water port 54, a cold water port 56, a hot water conduit 58 extending between the hot water port and the mixing ball, and a cold water conduit 59 extending between the cold water port and the mixing ball.

The mixing ball is operationally coupled to the second end 34 of the swivel bar such that movement of the swivel bar, using the foot pedal, adjusts relative amounts of hot and cold water passing through the mixing ball.

The outlet port is designed for coupling to a faucet such that the hot and cold water passing through the mixing ball is dispensable through the faucet.

The mixing ball 60 includes a mixing conduit 62. The mixing conduit comprises a hot water inlet opening 64 selectively alignable with the hot water conduit of the mixing valve. The mixing conduit also includes a cold water inlet opening 66 selectively alignable with the cold water conduit of the mixing valve and an outlet opening 68 selectively alignable with the outlet port of the mixing valve.

The mixing valve includes an upper portion 72 and a lower portion 74. The upper portion includes a depression 71 therein for receiving the mixing ball and a threaded lip 73 extending outwardly around the depression.

The lower portion includes threading 75 complementary to the threaded lip 73 such that the lower portion is couplable to the upper portion. The lower portion of the mixing valve is annular such that the swivel bar extends through a center opening 76 of the lower portion. In an embodiment, an annular collar 78 is positioned between the mixing ball and the lower portion of the mixing valve when the lower portion of the mixing valve is coupled to the upper portion of the mixing valve. The collar is designed for holding the mixing ball within the depression of the upper portion of the mixing valve during use.

The base includes a perimeter lip 18 extending upwardly from an outer periphery 17 of the upper surface 14 for preventing the foot pedal from moving outside of the outer periphery 17.

The foot pedal is positionable in a first position relative to the base such that the mixing conduit is not aligned with the hot water conduit and the cold water conduit, thus no water passes through the mixing valve. A biasing assembly 40 is coupled between the base and the foot pedal such that the biasing assembly urges the foot pedal into the first position.

In an embodiment, the biasing assembly includes a pair of spring members 42. Each spring member includes a first end 44 and a second end 46. The base plate includes a pair of spaced spring retainer portions 48 and the foot pedal includes a pedal spring retainer 49. Each first end 44 of the spring members is coupled to a respective one of the spring retainer portions 48. Each second end 46 of the spring members is coupled to the pedal spring retainer 49. Thus the biasing assembly centers and aligns the foot pedal into the selected position when no other forces are applied to the foot pedal, thus holding the mixing valve in a closed position.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A foot operated faucet system, comprising:

a base member having a substantially planar upper surface;

a foot pedal, said foot pedal being operationally coupled to the base member such that said foot pedal is movable within a plane substantially parallel to said upper surface of said base member;

a swivel bar having a first end and a second end, said first end being coupled to said foot pedal;

a mixing valve having a mixing ball, an outlet port, a hot water port, a cold water port, a hot water conduit extending between said hot water port and said mixing ball, and a cold water conduit extending between said cold water port and said mixing ball;

said mixing ball being operationally coupled to said second end of said swivel bar whereby movement of said swivel bar using said foot pedal adjusts relative amounts of hot and cold water passing through said mixing ball;

said outlet port being adapted for coupling to a faucet whereby said hot and cold water passing through said mixing ball is dispensable through said faucet.

2. The foot operated faucet system of claim 1, further comprising:

said mixing ball having a mixing conduit therein, said mixing conduit having a hot water inlet opening selectively alignable with said hot water conduit of said mixing valve, said mixing conduit having a cold water inlet opening selectively alignable with said cold water conduit of said mixing valve, and said mixing conduit having an outlet opening selectively alignable with said outlet port of said mixing valve.

3. The foot operated faucet system of claim 1, further comprising:

said mixing valve having an upper portion and a lower portion;

said upper portion having a depression therein for receiving said mixing ball;

said upper portion having a threaded lip extending outwardly from the upper portion around the depression;

said lower portion having complementary threading to said threaded lip such that said lower portion is couplable to said upper portion.

4. The foot operated faucet system of claim 3, further comprising:

said lower portion of said mixing valve being annular such that said swivel bar extends through a center opening of said lower portion.

5. The foot operated faucet system of claim 4, further comprising:

an annular collar positioned between said mixing ball and said lower portion of said mixing valve when said lower portion of said mixing valve is coupled to said upper portion of said mixing valve, said collar being for holding said mixing ball within said depression of said upper portion of said mixing valve.

6. The foot operated faucet system of claim 1, further comprising:

said base having a perimeter lip extending upwardly from an outer periphery of said upper surface for preventing said foot pedal from moving outside of said outer periphery.

7. The foot operated faucet system of claim 1, further comprising:

said foot pedal being positionable in a first position relative to said base such that no water passes through said mixing valve; and a biasing assembly coupled between said base and said foot pedal such that said biasing assembly urges said foot pedal into said first position.

8. The foot operated faucet system of claim 7, further comprising:

said biasing assembly having a pair of spring members, each spring member having a first end and a second end;

said base plate having a pair of spaced spring retainer portions coupled thereto;

said foot pedal having a pedal spring retainer coupled thereto;

each first end of said spring members being coupled to a respective one of said spring retainer portions;

each second end of said spring members being coupled to said pedal spring retainer.

9. The foot operated faucet system of claim 1, further comprising:

said foot pedal having a swivel bar receiver extending upwardly from an upper surface of the foot pedal;

said swivel bar receiver having a swivel receiver for receiving said first end of said swivel bar whereby said swivel bar is operationally coupled to said foot pedal;

a grommet coupled to said swivel bar receiver around said swivel bar.

10. The foot operated faucet system of claim 9, further comprising:

said swivel bar receiver having a groove extending around an outer peripheral wall of said swivel bar receiver for receiving a portion of said grommet whereby said grommet is coupled to said swivel bar receiver.

11. The foot operated faucet system of claim 1, further comprising:

a plurality of ball bearings positioned between said foot pedal and said base for facilitating movement of said foot pedal relative to said base.

12. A foot operated faucet system, comprising:

a base member having a substantially planar upper surface;

a foot pedal, said foot pedal being operationally coupled to the base member such that said foot pedal is movable within a plane substantially parallel to said upper surface of said base member;

a swivel bar having a first end and a second end, said first end being coupled to said foot pedal;

a mixing valve having a mixing ball, an outlet port, a hot water port, a cold water port, a hot water conduit extending between said hot water port and said mixing ball, and a cold water conduit extending between said cold water port and said mixing ball;

said mixing ball being operationally coupled to said second end of said swivel bar whereby movement of said swivel bar using said foot pedal adjusts relative amounts of hot and cold water passing through said mixing ball;

said outlet port being adapted for coupling to a faucet whereby said hot and cold water passing through said mixing ball is dispensable through said faucet;

said mixing ball having a mixing conduit therein, said mixing conduit having a hot water inlet opening selectively alignable with said hot water conduit of said mixing valve, said mixing conduit having a cold water inlet opening selectively alignable with said cold water conduit of said mixing valve, and said mixing conduit having an outlet opening selectively alignable with said outlet port of said mixing valve;

said mixing valve having an upper portion and a lower portion;

said upper portion having a depression therein for receiving said mixing ball;

said upper portion having a threaded lip extending outwardly from the upper portion around the depression;

said lower portion having complementary threading to said threaded lip such that said lower portion is couplable to said upper portion;

said lower portion of said mixing valve being annular such that said swivel bar extends through a center opening of said lower portion;

an annular collar positioned between said mixing ball and said lower portion of said mixing valve when said lower portion of said mixing valve is coupled to said upper portion of said mixing valve, said collar being for holding said mixing ball within said depression of said upper portion of said mixing valve;

said base having a perimeter lip extending upwardly from an outer periphery of said upper surface for preventing said foot pedal from moving outside of said outer periphery;

said foot pedal being positionable in a first position relative to said base such that no water passes through said mixing valve; and a biasing assembly coupled between said base and said foot pedal such that said biasing assembly urges said foot pedal into said first position;

said foot pedal having a swivel bar receiver extending upwardly from an upper surface of the foot pedal;

said swivel bar receiver having a swivel receiver for receiving said first end of said swivel bar whereby said swivel bar is operationally coupled to said foot pedal;

a grommet coupled to said swivel bar receiver around said swivel bar;

said swivel bar receiver having a groove extending around an outer peripheral wall of said swivel bar receiver for receiving a portion of said grommet whereby said grommet is coupled to said swivel bar receiver;

a plurality of ball bearings positioned between said foot pedal and said base for facilitating movement of said foot pedal relative to said base;

said biasing assembly having a pair of spring members, each spring member having a first end and a second end;

said base plate having a pair of spaced spring retainer portions coupled thereto;

said foot pedal having a pedal spring retainer coupled thereto;

each first end of said spring members being coupled to a respective one of said spring retainer portions;

each second end of said spring members being coupled to said pedal spring retainer.

* * * * *